US006827024B2

(12) United States Patent
Kassab et al.

(10) Patent No.: US 6,827,024 B2
(45) Date of Patent: Dec. 7, 2004

(54) MULTIPLE TRUCK RAIL VEHICLE WITH UNIFIED BOLSTER-CAR BODY

(75) Inventors: Gabe M. Kassab, Pittsburgh, PA (US); Jon Odden, Coon Rapids, MN (US)

(73) Assignee: Kasgro Rail Corp., New Castle, PA (US)

( * ) Notice: Subject to any disclaimer, the term of this patent is extended or adjusted under 35 U.S.C. 154(b) by 0 days.

(21) Appl. No.: 10/387,263

(22) Filed: Mar. 12, 2003

(65) Prior Publication Data

US 2003/0217669 A1 Nov. 27, 2003

Related U.S. Application Data

(60) Provisional application No. 60/367,041, filed on Mar. 22, 2002.

(51) Int. Cl.[7] ..... B61D 1/00

(52) U.S. Cl. ..... 105/157.1

(58) Field of Search ..... 105/151.1, 182.1, 105/185, 200, 201, 202

(56) References Cited

U.S. PATENT DOCUMENTS

| | | | | |
|---|---|---|---|---|
| 1,144,329 A | | 6/1915 | Howard et al. | |
| 1,504,252 A | | 8/1924 | Larsen | |
| 1,762,887 A | | 6/1930 | O'Brien | |
| 3,394,662 A | | 7/1968 | Weber | |
| 5,315,934 A | * | 5/1994 | List et al. | 105/199.3 |
| 5,327,837 A | | 7/1994 | Weber | |
| 5,632,208 A | | 5/1997 | Weber | |
| 5,802,981 A | * | 9/1998 | Kassab | 105/176 |
| 5,802,982 A | * | 9/1998 | Weber | 105/187 |

* cited by examiner

*Primary Examiner*—S. Joseph Morano
*Assistant Examiner*—Robert J. McCarry, Jr.
(74) *Attorney, Agent, or Firm*—Buchanan Ingersoll PC

(57) ABSTRACT

The invention provides a multiple axle rail vehicle wherein the car body of the rail vehicle is provided with multiple center plate members at each end of the car body. Multiple trucks are attached to each end of the car body with each truck individually connected to a respective center plate. Connecting each truck to an individual center plate on the car body eliminates the span bolster permitting the rail vehicle to weigh less and have a lower deck height.

6 Claims, 6 Drawing Sheets

LATERAL SHIFT
(PRIOR ART)

MULTIPLE TRUCK RAIL VEHICLE WITH UNIFIED BOLSTER-CAR BODY

CROSS REFERENCE TO RELATED APPLICATION

This application claims priority to U.S. Provisional Patent Application Ser. No. 60/367,041, filed Mar. 22, 2002.

BACKGROUND

Rail vehicles have progressed from the simplest vehicle having a generally fixed axle at each end and four wheels to multiple axle vehicles with rotatably attached trucks. As the requirements to carry increased loads have increased, it has been required to increase the number of weight bearing wheel and axle assemblies to maintain reasonable rail/wheel loading. A present commonly used higher load freight car rail vehicle utilizes a four axle suspension, comprising one two-axle truck supporting each end of the rail vehicle. Each truck includes two axles, each generally held in a set of side frames with a bolster running between the side frames. The bolster of each truck is rotatably connected to a center plate associated with the connection to the freight car body. With such a 2-axle bolster rotatably mounted on opposite ends of the car, the car is able to self-steer around curves. For some higher load freight car applications it is known to use 3-axle trucks in place of the 2-axle trucks, with one 3-axle truck similarly mounted at each end of the rail vehicle, the truck bolster at each end of the rail vehicle being connected via a center plate. This arrangement provides a six axle (or twelve wheel) rail vehicle. The provision of two additional axles (four more wheels) can provide the desired higher carrying capacity of the rail vehicle. However, as the desire to carry increased loads has demanded additional axle sets (wheels), the dynamic performance of additional axles upon the car operation has been difficult to maintain consistent with existing track. One prior art solution to increasing the carrying capacity of rail vehicles has been to utilize twelve axles in four trucks, each truck having 3-axles. This type of rail vehicle employs a member known as a span bolster. A span bolster is rotatably connected to each end of the car body via a center plate. Then, the bolster of each of the two 3-axle trucks which support each end of the rail vehicle is rotatably mounted to the span bolster via a center plate. An example of one such vehicle is known as QTTX131100, and is manufactured by National Steel Car Limited, of Canada. While such a vehicle does have the weight capacity, resulting from the twelve axle/twenty-four wheel arrangement, the dynamics and performance of this rail vehicle on curved track can be less than desired.

Track curvature, and other roadway variables, can make multiple axle high speed rail operation difficult. In particular, the ability of the rail vehicle to safely traverse curved track sections can be degraded as the number of axle sets at each end of the rail vehicle is increased. The reason for this results from the circumstance that the center of each truck is held generally centered between the rails by the center plate connection and by virtue of the truck wheels being confined between the track rails. The center of each truck generally corresponds to the point of rotation of the center plate on the truck bolster. Although rotation is permitted, the center of each truck has generally been constrained in the lateral direction by the center plate connection. This is the case because the axles, via the wheels, of each truck are laterally constrained by the rails to a position generally centered between the rails. Yet, it is understood that there is some play, i.e., small degree of movement, inherent in all three piece trucks. As the trucks at the front and rear of the car body traverse curved track, the rails hold the center point of each truck to a position generally centered between the rails. On straight track, the center/center line of the car body will be generally aligned with the center line of the rails. However, the car body is rigid, i.e., does not "bend," and thus cannot follow the curvature of the track. Consequently, the center of the rigid car body must laterally shift (toward the center of the radius of curvature) with respect to the rails when a curved track section is traversed. Generally, in order to enable lateral displacement of the center of the car body, each end of the car body must be free to rotate about the connection of the truck bolsters with respect to the other end of the car body. Where multiple trucks are employed at each end of the rail vehicle, a span bolster has been necessary to enable each end of the car body to rotate with respect to the trucks to provide the necessary lateral displacement when curved track is traversed.

However, a disadvantage the span bolster is that the deck height of the car body is increased due to the presence of the span bolster between the trucks and the car body. Additionally, the weight of the rail vehicle is increased by the weight of the span bolster and associated mounting members. Eliminating the span bolster would reduce the weight of the rail vehicle and enable a lower deck height, as well as simplifying and reducing the cost of making multiple truck, high weight capacity rail vehicles. Therefore, it would be desirable to provide a high load multiple axle rail vehicle which weighs less, has a low deck height, and maintains the necessary dynamic performance compatible with existing rail conditions.

SUMMARY

According to the invention, a rail vehicle can be supported at each end by multiple trucks each connected individually to the car body of the rail vehicle. A center plate on each of the multiple trucks can be attached to separate, mating center plate mounts on the underside of the car body, at each end of the car body. Connecting each truck to an individual center plate mount on the car body eliminates the need for the span bolster which is conventionally connected intermediate the multiple trucks and the car body at each end of the rail vehicle. Elimination of the span bolster between the car body and the trucks permits the deck height of the rail vehicle to be significantly lower. Moreover, the weight of the rail vehicle can be reduced by the weight of the span bolster.

In a certain embodiment, a pair of trucks can be provided at each end of the rail vehicle. The trucks can be specially designed to provide an increased amount of lateral travel to accommodate lateral movement of the truck with respect to the car body sufficiently to permit the rail vehicle to travel curved track sections with the requisite dynamic performance compatible with existing track conditions. Additionally, the center plate connections between the trucks and the car body can be designed to provide a degree of lateral movement to supplement the lateral displacement enabled by the specially designed trucks. Each truck can be a specially modified swing motion type truck wherein the distance between transom stops is increased to permit more lateral travel for the bolster and a higher degree of lateral displacement of the bolster, and thus the center plate member. Additionally, non-standard spring sets can be utilized on one or more of the trucks, including taller springs, which further increase the amount of lateral displacement which can be provided. The increased height which can result from using taller springs can be offset by the lower height enabled by elimination of the span bolster.

Other details, objects, and advantages of the invention will become apparent from the following detailed description and the accompanying drawings FIGS. of certain embodiments thereof.

DESCRIPTION OF CERTAIN EMBODIMENTS

Figure 1:
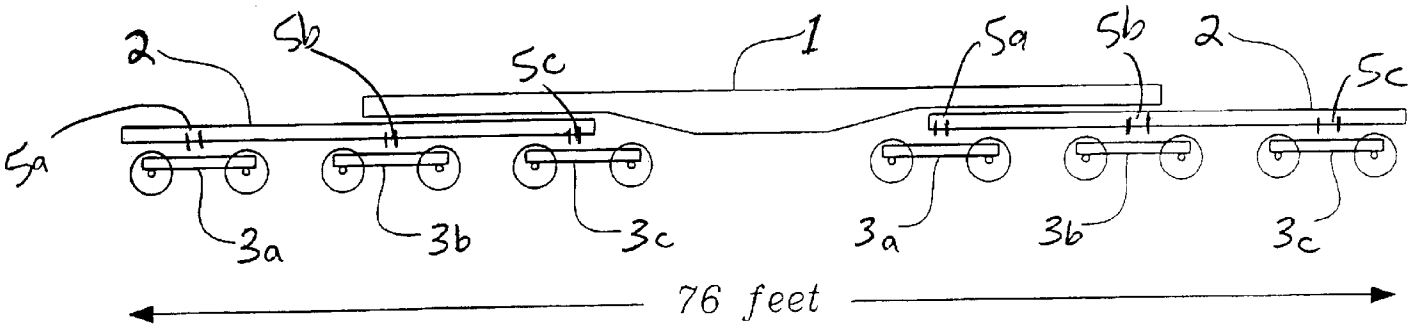
FIG. 1 (PRIOR ART)
FIG. 1 shows a prior art twelve axle rail vehicle.

The invention can be better understood after a description of the prior art and the attendant disadvantages thereof which can be overcome by a rail vehicle according to a presently preferred embodiment of the invention. To overcome less than desirable dynamics and performance problems which can be associated with multiple axle rail vehicles like the aforementioned 12 axle QTTX131100 rail vehicle, a high weight capacity rail vehicle with improved dynamic performance is described in U.S. Pat. No. 5,802,981 ("the '981 patent"). An embodiment of a 12-axle rail vehicle 1 such as described in the '981 patent is shown in FIG. 1, which generally corresponds to FIG. 2 in the '981 patent. This 12 axle rail vehicle 1 can employ three 2 axle trucks 3*a*–3*c* at each end of the rail vehicle 1, instead of a pair 3 axle trucks as utilized at each end of the QTTX131100 rail vehicle (not shown). The three 2 axle trucks 3*a*–3*c* at each end of the 12 axle rail vehicle 1 do provide for improved dynamics and performance, as described in described in the '981 patent. However, the 12 axle rail vehicle 1, like the QTTX131100 rail vehicle, does employ a span bolster 2 at each end of the rail vehicle to which each truck 3*a*–3*c* is connected via center plate mountings 5*a*–5*c*.

Where multiple trucks have been employed to support each end of a rail vehicle, span bolsters have been necessary to permit the each end of the rail vehicle to rotate about a common point with respect to the truck sets, that point being the center plate at each end of the car body to which the span bolsters are connected. This type of arrangement has been required to enable the needed lateral displacement of the car body when the rail vehicle travels curved track sections.

Figure 2:
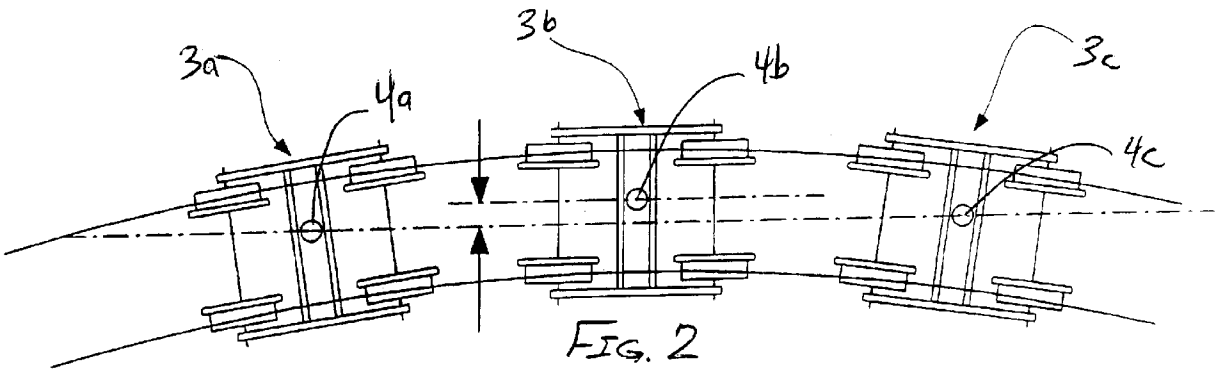
FIG. 2 illustrates the lateral displacement which must be accommodated by the rail vehicle shown in FIG. 1 to traverse a curved track section.

In addition to the lateral displacement which must be accommodated by the car body, the span bolster itself can be required to accommodate some degree of lateral displacement when curved track is traversed. In the case of the 12-axle rail vehicle 1 having three 2 axle trucks 3*a*–3*c* connected to each span bolster 2, this can necessitate some degree of lateral shift be accommodated by each center truck 3*b* with respect to the center plate connection 4*b* to the center plate mount 5*b* of each span bolster 2. The required lateral shift is illustrated in FIG. 2, which corresponds to FIG. 5 of the '981 patent. As explained in the '981 patent, the necessary amount of lateral shift for the middle truck 3*b* in can be accomplished in three ways: by designing the middle center plate mount 5*b* of the span bolster 2 to permit some lateral movement; by utilizing the high degree of lateral suspension travel of swing motion trucks; and by taking advantage of some additional travel available at the wheel-rail interface.

Figure 3:
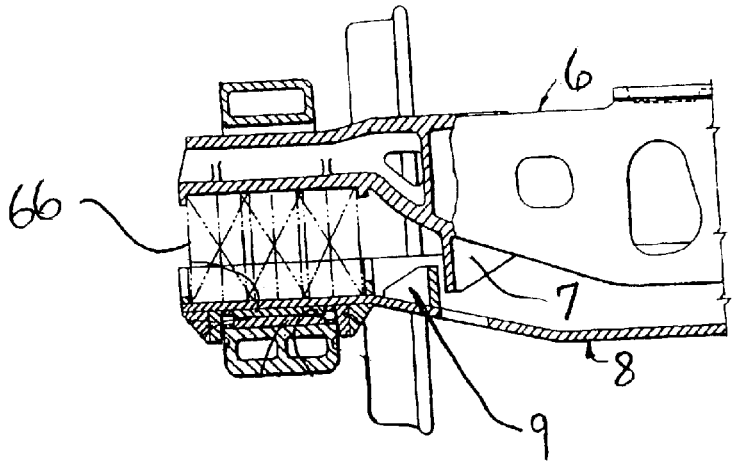
FIG. 3 (PRIOR ART)
FIG. 3 is a sectional view of a prior art swing motion truck with a movable bolster.
Figure 4:
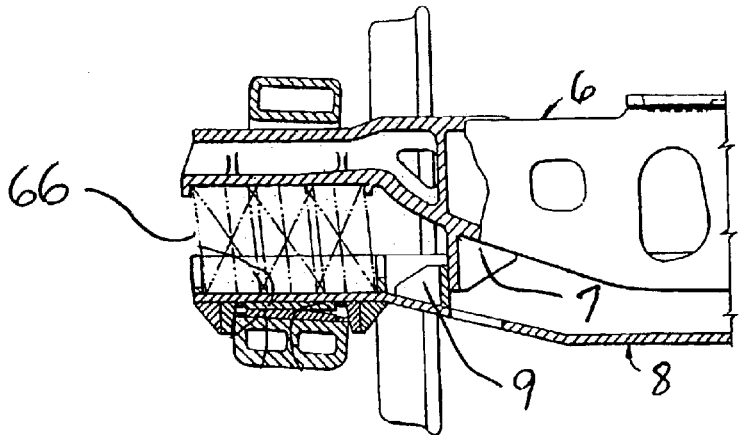
FIG. 4 (PRIOR ART)
FIG. 4 is a sectional view of the prior art swing motion truck shown in FIG. 3 after full bolster movement.
Figure 12:
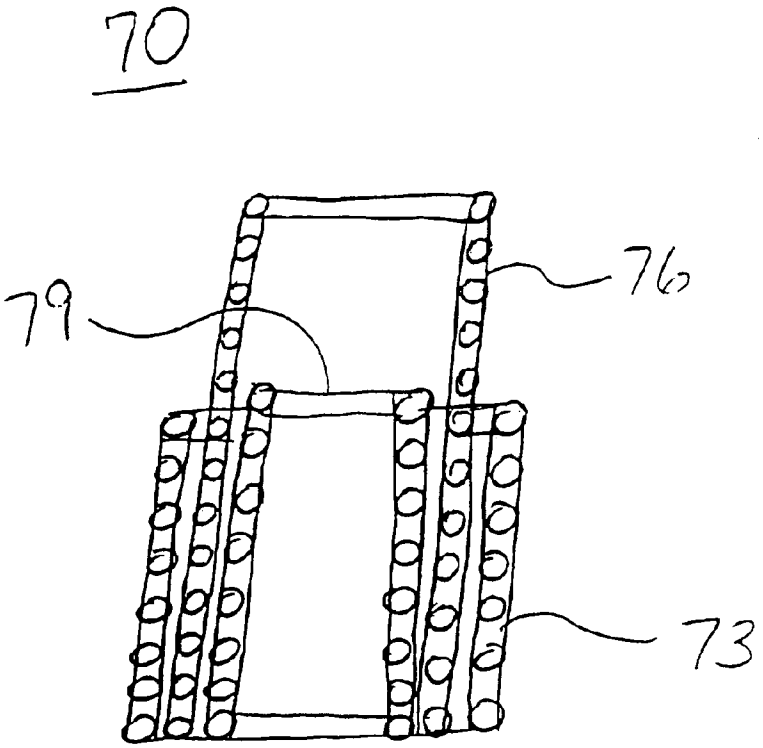
FIG. 12 shows an embodiment of a truck spring set according to the invention.
Figure 11:
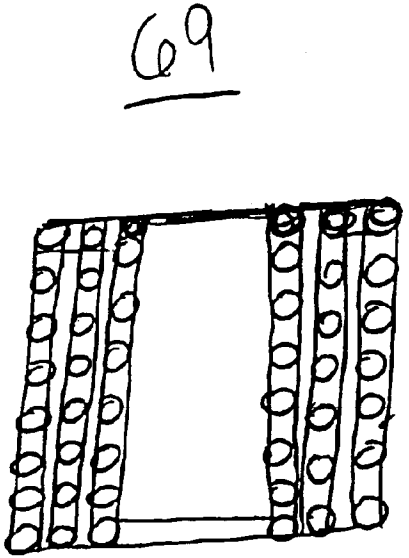
FIG. 11 (PRIOR ART)
FIG. 11 shows a prior art truck spring set.
Figure 1:
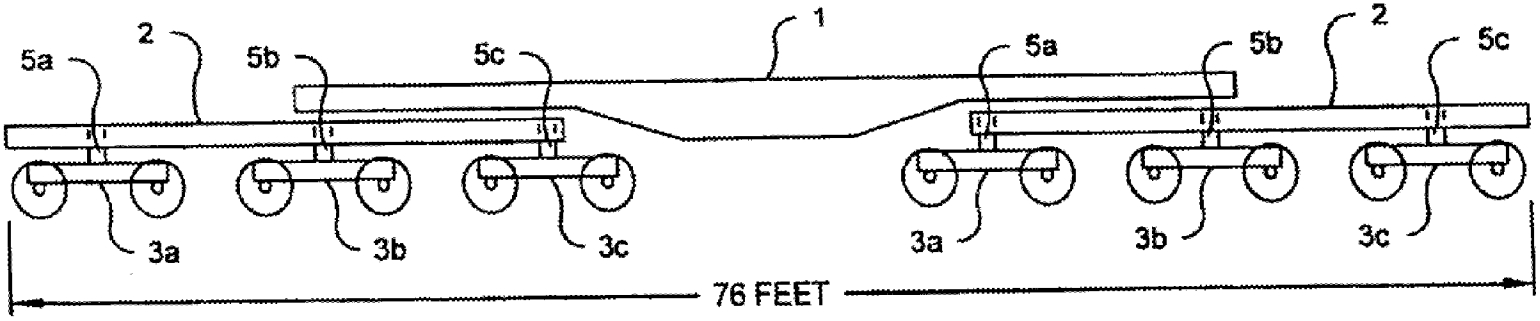
Fig. 1 (Prior Art)
Figure 2:
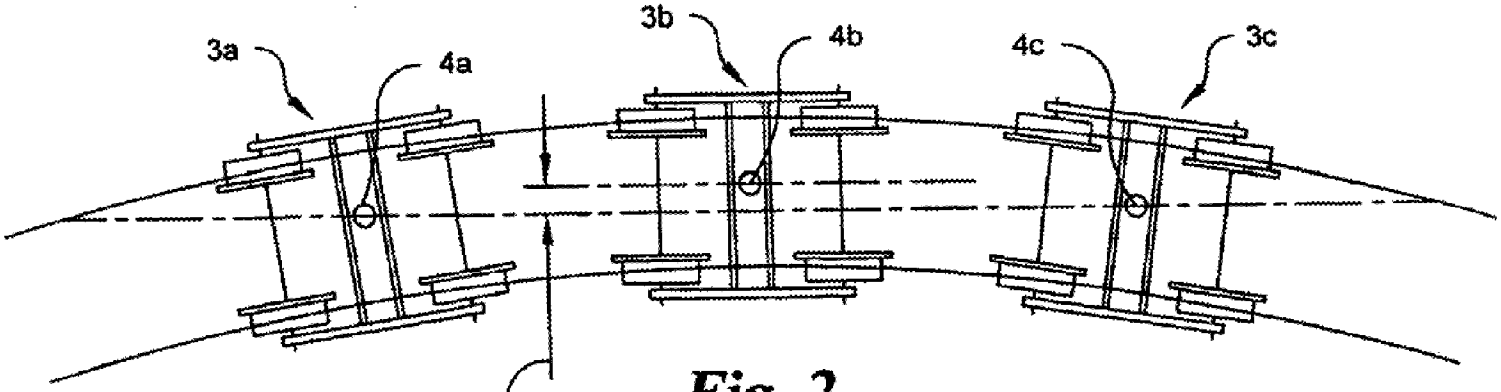
Fig. 2 (Prior Art)
Figure 3:
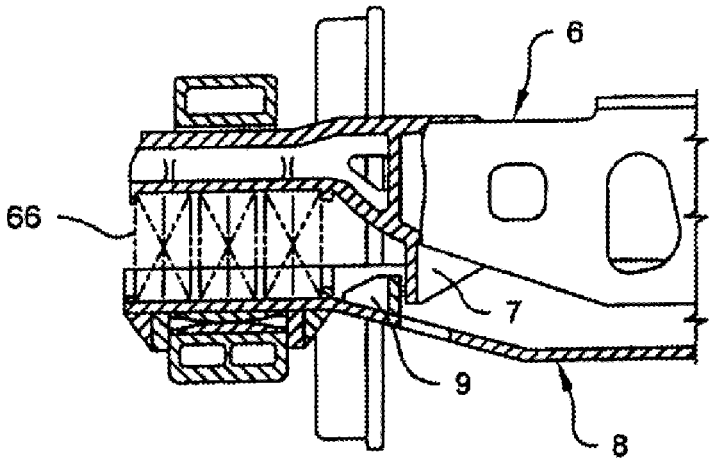
Fig. 3 (Prior Art)
Figure 4:
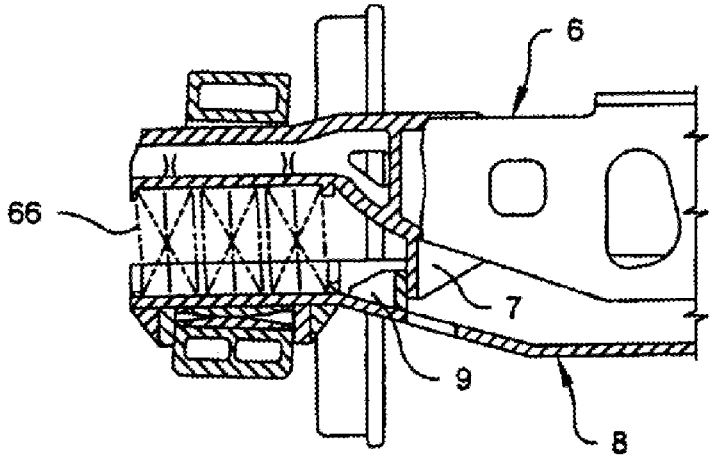
Fig. 4 (Prior Art)
Figure 5:
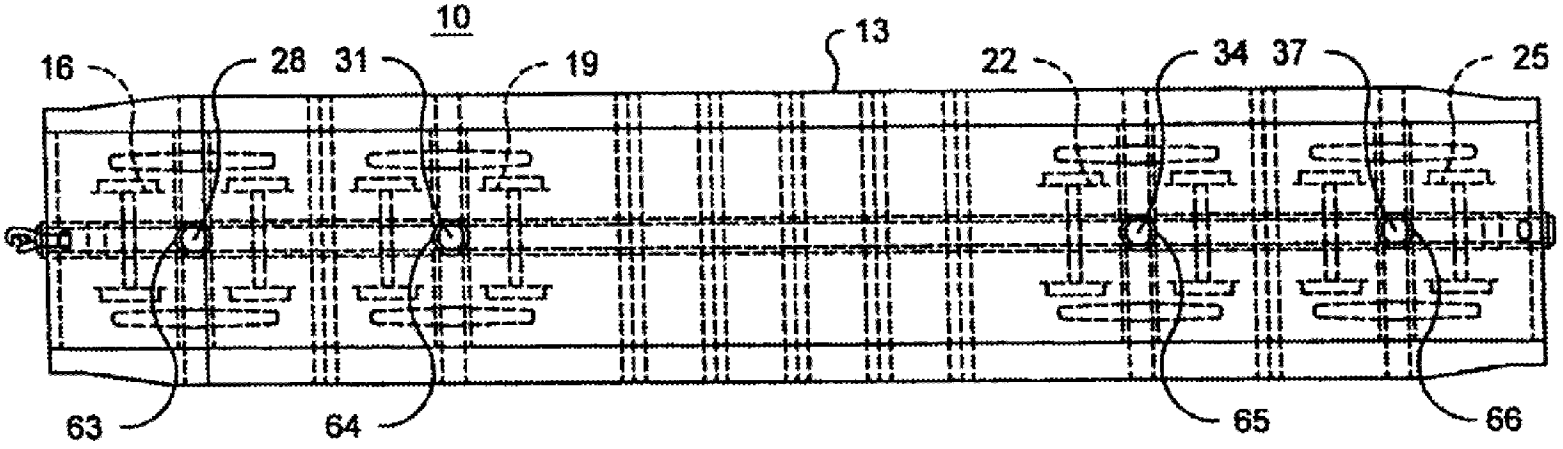
Figure 6:
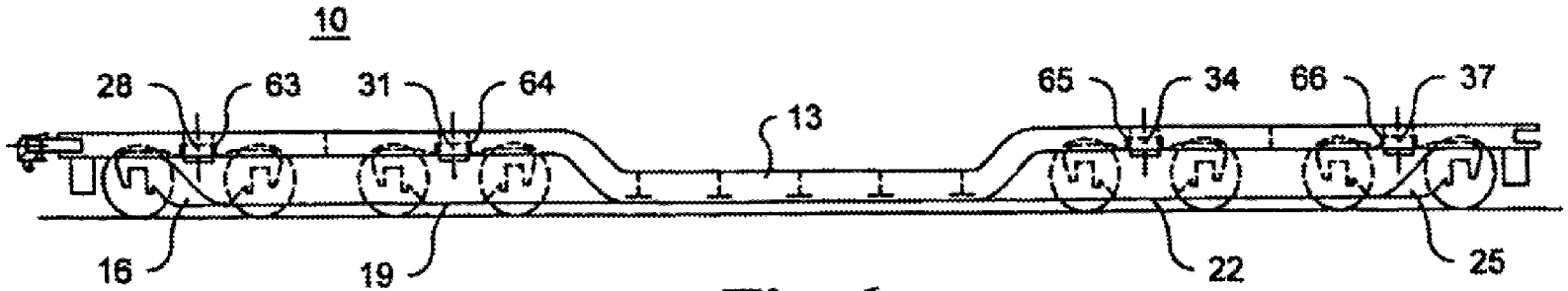
Figure 10:
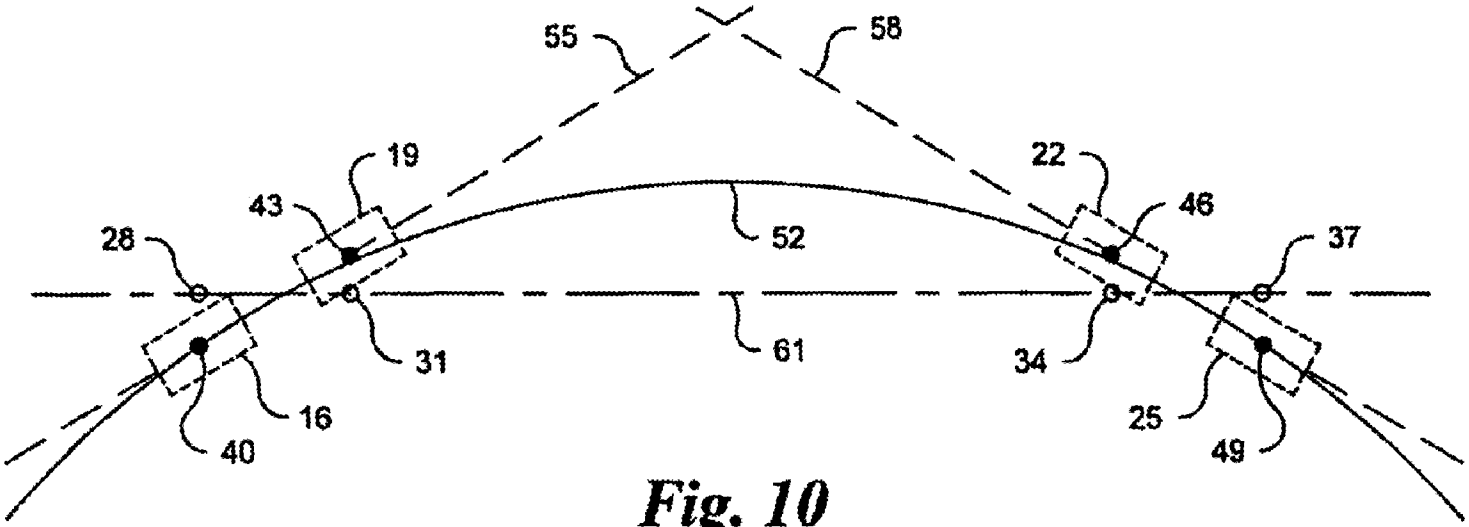
Figure 12:
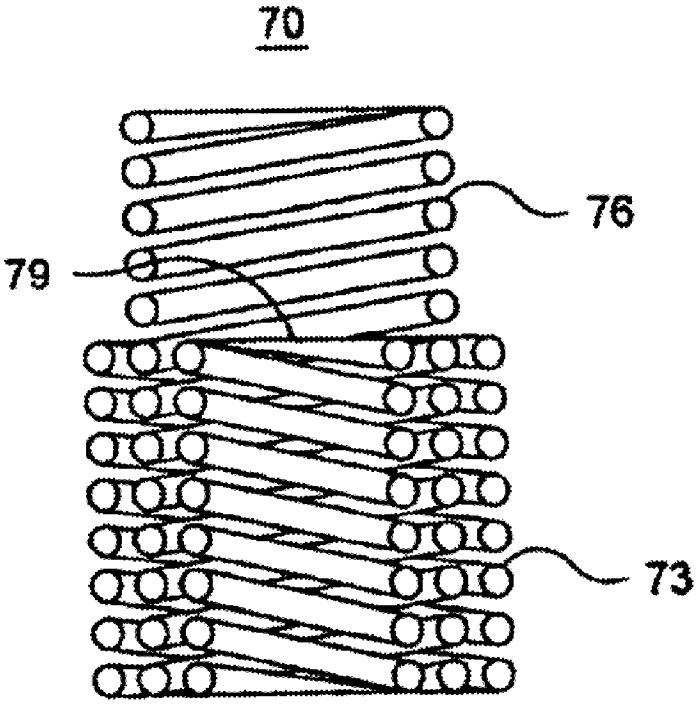
Figure 11:
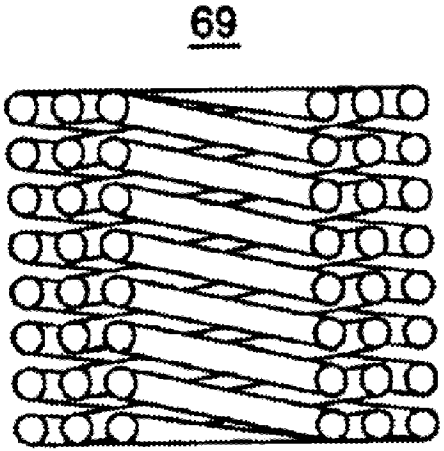
Fig. 11 (Prior Art)

In FIGS. 3 and 4, which generally correspond to FIGS. 11 and 12 of the aforementioned U.S. Pat. No. 3,670,660, the lateral suspension travel of such prior art type swing motion trucks is illustrated. In addition to improvements in multiple axle rail vehicles resulting from the increased demand for high capacity rail vehicles, there have also been advancements made in rail car truck designs. Specifically, improvements have been made to combat problems of excessive car roll created by high capacity, high center of gravity freight rail vehicles. Examples of such improvements are disclosed in U.S. Pat. Nos. 3,461,814, 3,670,660, and 5,802,982, which all pertain to what have commonly become known as "swing motion trucks." The latter, and most recent, patent describes an optimized roll control mechanism for a swing-motion rail car truck of the type described in the former two patents. The swing-motion trucks disclosed in the two former patents were designed to lower the critical speeds at which periodic track disturbances could cause resonance conditions with the sprung car body, and, therefore uncontrolled car body hunting. One object of the design of the swing motion railway car truck was to provide a railway car truck having embodied therein a positive means to check and control excessive roll amplitudes of an associated car body.

The side, partially in section, views in FIGS. 3 and 4 illustrate half of the truck, the other half being generally a mirror image, and show the basic members of a swing motion truck. The basic members include, inter alia, a bolster 6 having a downwardly depending bolster stop 7 which is confined within a range of movement defined by a lateral transom stop 9 which projects upwardly from a transom member 8. Although not shown in the section view, corresponding bolster and transom stops are provide at the other side of the truck. FIG. 3 shows the bolster 6 in a neutral, centered state, such as when the truck is traveling in a straight line, whereas FIG. 4 illustrates the truck at full lateral displacement, wherein the bolster stop 7 has contacted the stop 9 on the transom 8.

As described in aforementioned U.S. Pat. No. 5,802,982 ("the '982 patent"), the design was to provide a car truck for high capacity, high center of gravity railway freight car use of the type in which the lateral transom stop extending from the transom interconnects with the side frames to limit the side frames from swinging transversely of the truck excessively in which the effect of the laterally directed forces applied to the lateral transom stop of the truck is reduced to provide safer operation of the car. The roll control feature of the swing motion truck functioned on the basis of reducing the overturning moment imposed on the unsprung truck by the rolling car body. On a standard freight car truck, the lateral translation of the rolling car body forces the bolster gibs against the side frame columns at an average height of approximately 20¼ inches from the top of the rail. Closed bolster gibs help stop further roll motion of the car body-bolster assembly with a lateral force imposed at 20¼ inches from the top of the rail. This arrangement provides for an overturning moment, equaling 20¼ inches multiplied by the lateral force, which can unload or even lift the wheel off the track on the opposite side of the truck. The swing motion truck as disclosed in the two former patents does not have a bolster gib but has lateral stops on the bottom of the bolster and the transom. With this construction, even with the tilt of the bolster relative to the transom being (+/−) 2.2 degrees, because of a 1½ inch compression of load springs on one side of the truck and 1½ inches of extension of load springs on the other side of the truck, the lateral force applied to the unsprung truck is at a level of 11⅝ inches above the top of the rail. This results in a much lower overturning moment, which is 11⅝ inches multiplied by the lateral force, than on the standard truck having bolster gibs. The improvement described in the '982 patent is a control mechanism for optimizing the use of lateral stops used to lower the overturning moment imposed on the unsprung truck by the rolling car. In particular, the control mechanism includes a transom stop, adapted to be attached to the transom of the truck, having a convex cylindrical surface with a tip that is adapted to engage a bolster stop attached to the truck bolster to limit lateral movement of the side frames. The convex cylindrical surface of the transom stop provides a low point of contact between the tip of the transom stop and the bolster stop thereby further reducing the magnitude of the overturning movement created by such contact. A by-product of this type of bolster-transom arrangement, as yet recognized only by the Applicant and as described herein, is that a degree of lateral displacement of the center point of the truck is permitted.

As described in the '981 patent, a by-product of the swing motion trucks is that the "roll" safely permitted by the trucks also results in high degree of lateral suspension travel. Consequently, the amount of lateral displacement required to be accommodated by the span bolster connection to the middle truck, or a car body, is sufficiently reduced because some of the requisite lateral displacement is accommodated by the trucks. As a consequence of the lateral movement being provided by the trucks and also by the middle center plate on the span bolster, the amount of lateral displacement which would otherwise have be accommodated by the span bolster of the 12-axle rail vehicle is reduced. However, despite the manner in which the 12-axle rail vehicle enables the use of three trucks on a single span bolster, the utilization of the span bolster itself causes the rail vehicle to weigh more and have a higher deck height than it would if the span bolster could be eliminated.

Figure 5:
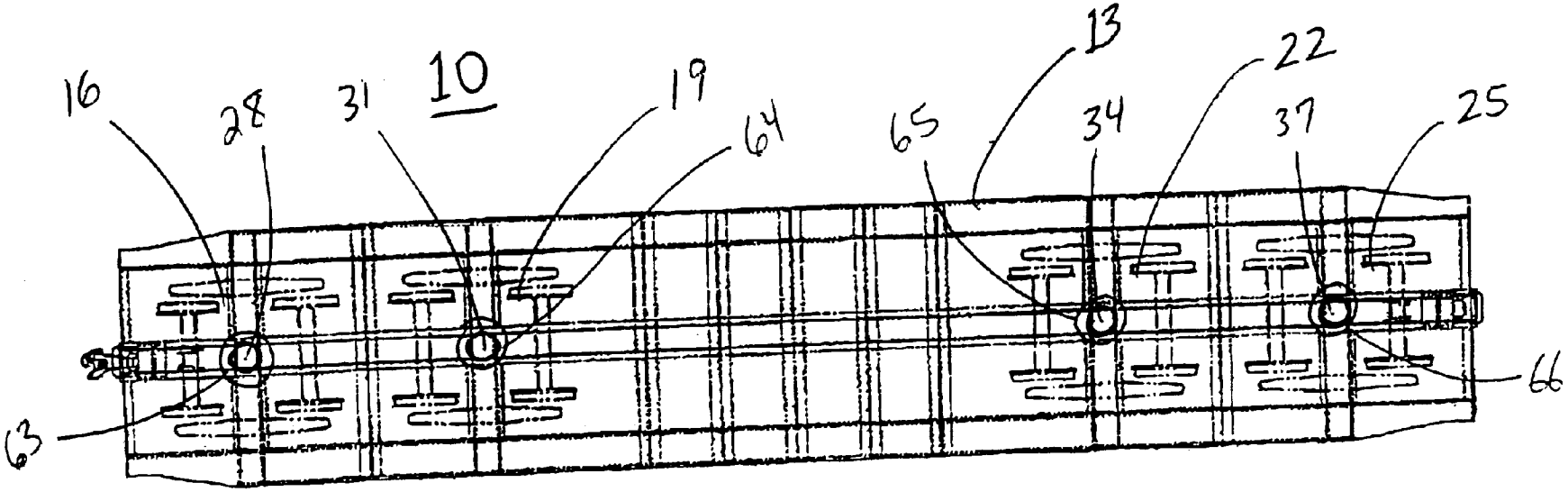
FIG. 5 shows an embodiment of a rail vehicle having a pair of trucks attached to the car body at each end of the rail vehicle.
Figure 6:
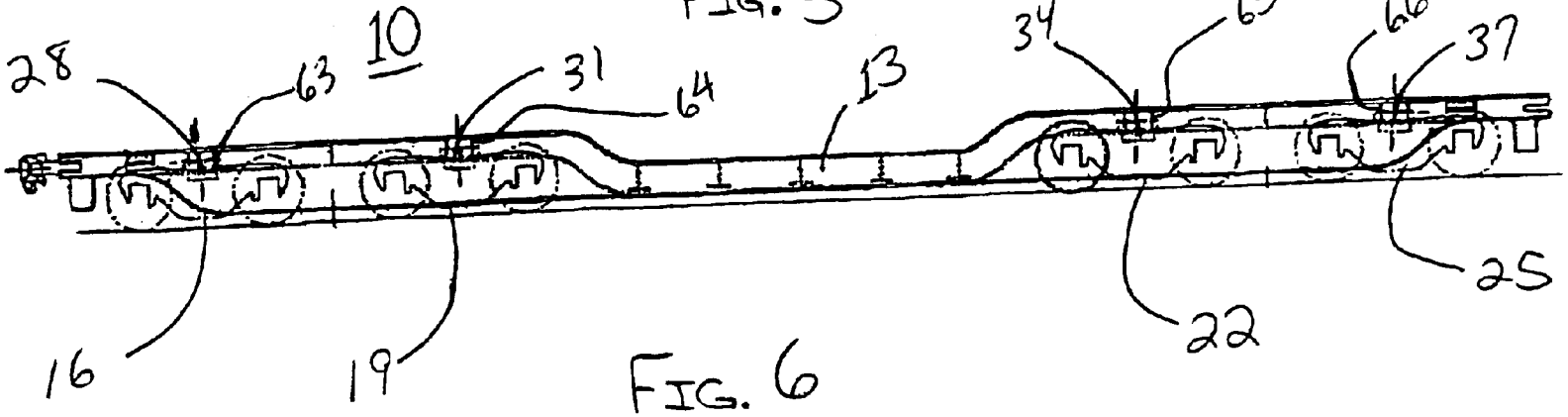
FIG. 6 is a side view of the rail vehicle shown in FIG. 5.

Referring now to FIGS. 5 and 6, a presently preferred embodiment of an 8 axle rail vehicle 10 according to the invention is illustrated wherein pairs of trucks 16, 19 and 22, 25 can be individually mounted, for example, via truck center plates 28, 31, 34, 37 to car body 13 center plate mounts 63, 64, 65, 66 at each end of the rail vehicle 10, without a span bolster intermediate each pair of trucks 16, 19 and 22, 25 and the car body 13. The connection of each truck 16, 19, 22, 25 to the car body 13 of the rail vehicle 10 enables provision of a lower than normal deck height due to the absence of the conventionally requisite span bolster. In preparing the car body 13 of the rail vehicle 10 for connection of the individual trucks 16, 19, 22, 25, the center plate mounts 63, 64, 65, 66 on the car body 13, or the area where they are provided, can be made level at each center plate mount 63, 64, 65, 66. This can be done, for example, by machining, to ensure proper operation of the rail vehicle 10. Additionally, for like reasons, the location of each center plate mount 63, 64, 65, 66 can be carefully determined such that the load is equally distributed when the center plates 28, 31, 34, 37 of the truck bolsters 29, 32, 35, 38 are mounted to the car body 13.

Figure 7:
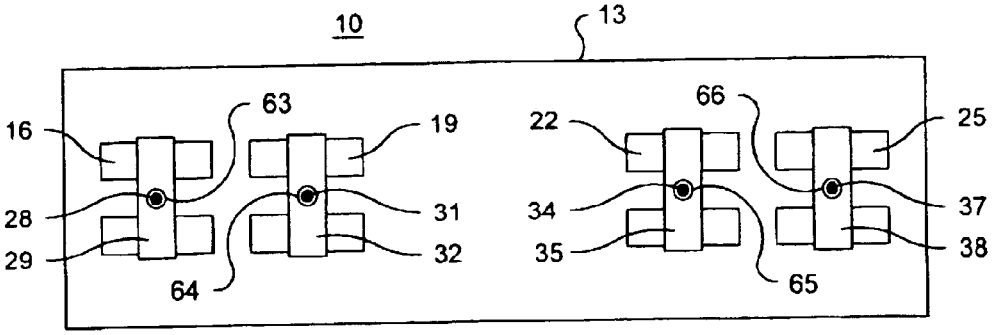
FIG. 7 is a diagrammatic top view of an embodiment of a rail vehicle according to the invention.
Figure 8:
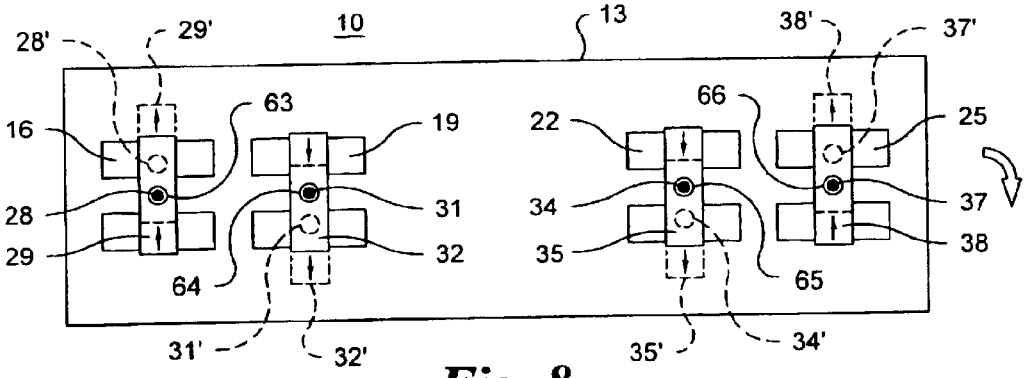
FIG. 8 is a view similar to FIG. 7, except showing lateral displacement of the bolsters of the trucks supporting the rail vehicle as would occur when traversing a curved track section.
Figure 9:
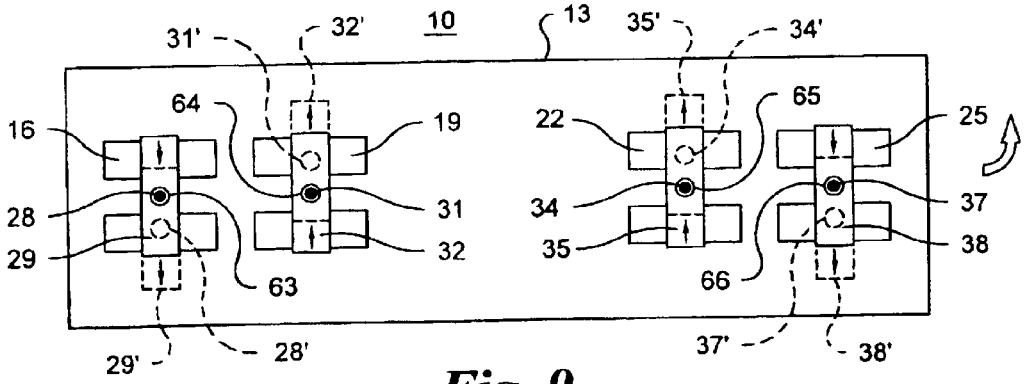
FIG. 9 is a view similar to FIG. 8, except as would occur when the rail vehicle traversed the curve in the opposite direction.

FIGS. 7 through 9 are diagrammatic top views of the rail vehicle 10, illustrating the trucks 16, 19, 22, 25, two of which are attached to the car body 13 at each end of the rail vehicle 10, such as by connecting center plates 28, 31, 34, 37 on the truck bolsters 29, 32, 35, 38 to mating center plate mounts 63, 64, 65, 66 on the car body 13. Additionally, the trucks 16, 19, 22, 25 can have bolsters 29, 32, 35, 38 which can be movable, like the truck bolster 6 of the swing motion truck shown in FIGS. 3 and 4. Referring particularly to FIG. 7, the truck bolsters 29, 32, 35, 38 are shown in a centered position, as they could generally be located when the rail vehicle 10 is traveling a straight track section and the bolsters 29, 32, 35, 38 are not undergoing any lateral displacement. In contrast, FIG. 8 shows the lateral displacement of the truck bolsters 29, 32, 35, 38 when the rail vehicle travels a curved track section in the direction shown by the arrow. The displaced position of the truck bolsters 29, 32, 35, 38 is indicated by the truck bolsters 29', 32', 35', 38' shown in dashed outlines. As a result, the position of the center plates 28, 31, 34, 37 are shifted to the position of the center plates 28', 31', 34', 37', respectively, shown in dashed lines. The direction of the lateral displacement of the truck bolsters 29, 32, 35, 38 is shown by the arrows. FIG. 8 similarly shows the displacement of the truck bolsters 29', 32', 35', 38', in dashed outlines, except that the rail vehicle 10 is traveling a curved track section the opposite direction, shown by the arrow, from the turning direction depicted in FIG. 8. Likewise, this results in the position of the center plates 28, 31, 34, 37 being shifted to the position of the center plates 28', 31', 34', 37', respectively, shown in dashed lines.

Referring back to FIG. 2, it can be understood that when multiple trucks 16, 19 and 22, 25 are connected directly to the car body 13 at each end of the rail vehicle 10, no single point of rotation will exist with respect to each end of the rail vehicle 10 as normally is the case with a span bolster. Thus, the amount of lateral shift that the car body 13 can accommodate without the span bolsters can be greatly reduced. In the embodiment of the rail vehicle 10 shown, the individual trucks 16, 19, 22, 25, like the middle truck 3*b* on each span bolster 2 in FIG. 1, must accommodate some degree of lateral displacement relative to the car body 13 at each end of the rail vehicle 10 in order for the rail vehicle 10 to traverse curved track sections.

Figure 10:
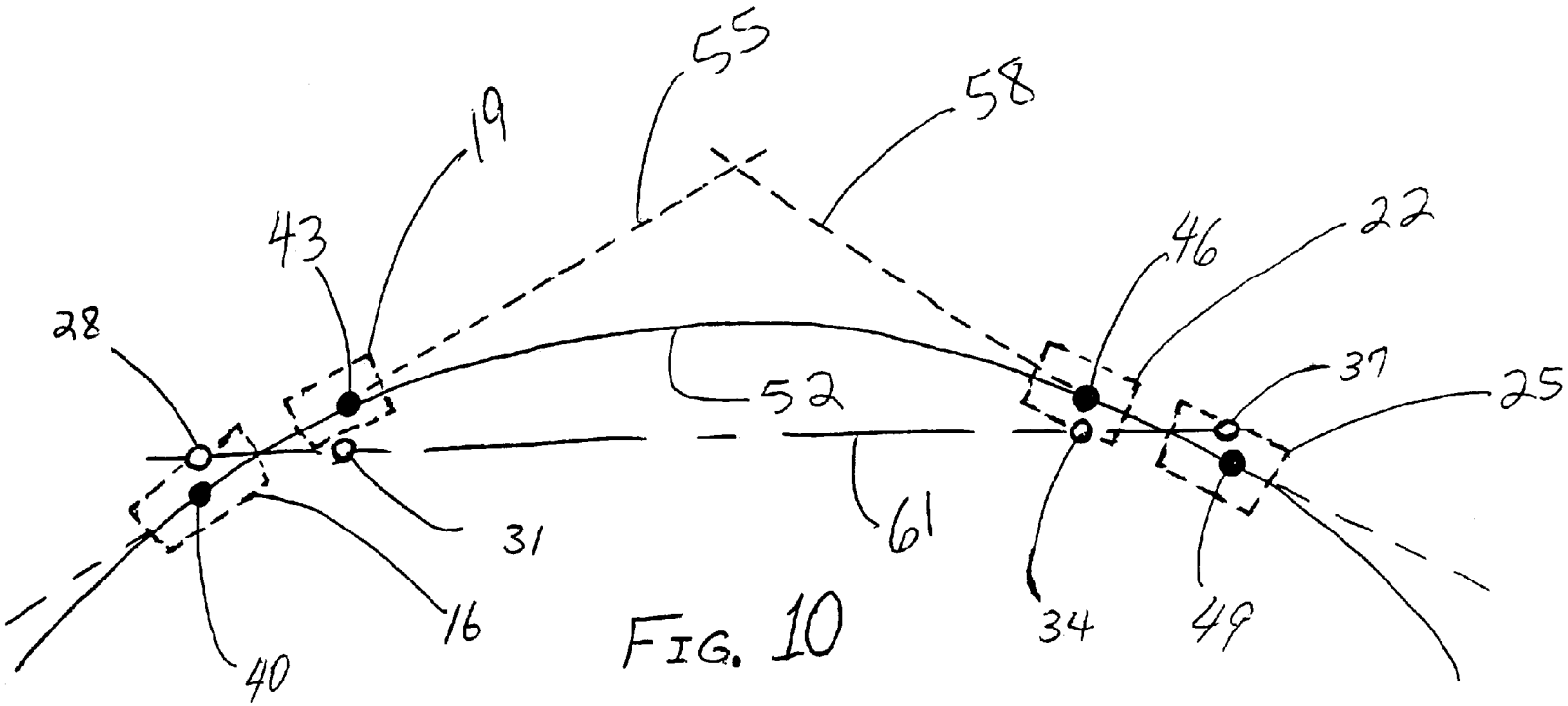
FIG. 10 illustrates the lateral displacement which must be accommodated by the rail vehicle when traversing a curved track section.

FIG. 10 schematically illustrates the displacement of the truck bolsters 29, 32, 35, 38 when the train travels a curved track section, in this case in a clockwise direction, which corresponds to FIG. 7. As shown, the requisite lateral shift which must be accommodated by each truck 16, 19, 22, 25 to permit the rail vehicle 10 to traverse the curved track section can be represented by the distance between the pairs of solid dots 40, 43, 46, 49 and open dots 28, 31, 34, 37. However, it should be noted that the degree of displacement is exaggerated for purposes of making the displacement more noticeable in the diagram. The degree of lateral displacement which must be accommodated by the trucks 16, 19, 22, 25 the rail vehicle traverses a curved track section is generally dependent upon two factors—the radius of the curvature of the track section and the length of the car body 13. As the radius of the track curvature decreases, or the length of the car body increases, the amount of lateral displacement of the car body required for the rail vehicle 10 to traverse the curved track section correspondingly increases.

FIG. 10 is provided to illustrate the nature of the lateral displacement required for the rail vehicle 10 to negotiate a curved track section. Each truck 16, 19, 22, 25 is represented by a rectangle in dashed lines. Solid dots 40, 43, 46, 49 can represent the center of the trucks 16, 19, 22, 25, i.e., midway between the track rails and midway between the front and rear axles sets of the trucks 16, 19, 22, 25. Because the wheels are constrained by the track rails, the solid dots 40, 43, 46, 49 will always fall on line 52, which represents the centerline of the track rails. Each solid dot 40, 43, 46, 49 can also represent generally the point where the center plate 28, 31, 34, 37 on the bolster 29, 32, 35, 38 of each truck 16, 19, 22, 25 would be located if the bolsters 29, 32, 35, 38 were restrained, and could not move laterally with respect to the axles of the trucks 16, 19, 22, 25. On the other hand, each open dot 28, 31, 34, 37 represents the center plate on each bolster 29, 32, 35, 38, which must therefore also correspond to the center plate mounts 63, 64, 65, 66 on the car body 13 to which they are attached. Since center plate mounts 63, 64, 65, 66 are generally positioned along the center of the rail vehicle 10, open dots 28, 31, 34, 37 will thus also always fall on line 61, which represents the centerline of the rail vehicle 10. Dashed line 55 is a generally straight line through solid dots 40 and 43, indicating a path always generally tangent to line 52, which the centers 40 and 43 of trucks 16 and 19 would generally be constrained to follow, if the trucks 16 and 19 were perfectly rigid, i.e., that the bolsters 29 and 32 could not move laterally. Likewise, dashed line 58 represents a generally straight line through solid dots 46 and 49, which similarly indicates a path tangent to line 52 at any given point, which the center 46 and 49 of trucks 22 and 25 would generally be constrained to follow if the trucks 22 and 25 were perfectly rigid. Dashed lines 55 and 58, are both generally tangent to line 52 at any given position of the pair of trucks 16, 19 and 22, 25 on the curved track section. Therefore, as the trucks 16, 19, 22, 28 move through the curve, the angle between lines 55 and 58 would remain generally constant if the trucks 16, 19, 22, 25 were rigid and provided no lateral displacement whatsoever. Under those conditions, unless the car body 13 could bend around the curve, thus permitting line 55 to align with line 58, the rail vehicle 10 could not traverse the curved track if the trucks 16, 19, 22, 25 were rigid. However, the car body 13 is rigid, and thus cannot bend to follow the curvature of the track. Therefore, unless the trucks 16, 19, 22, 25 at each end of the rail vehicle 10 provided the necessary lateral displacement, i.e., the distance between the solid dots 40, 43, 46, 49 and open dots 28, 31, 34, 37, respectively, the rail vehicle 10 would not be able to negotiate the curved track.

According to an embodiment of the invention, one, or both, of each truck pair 16, 19 and 22, 25 at each end of the rail vehicle 10 can have a movable bolster 29, 32, 35, 38 which can provide sufficient lateral displacement of the bolster center plates 28, 31, 34, 37 with respect to the axles of the trucks 16, 19, 22, 25. In particular, the bolsters 29, 32, 35, 38 of at least one of each pair of trucks 16, 19 and 22, 25 at each end of the rail vehicle 10 can be designed to displace laterally enough to accommodate the requisite lateral movement at each end of the rail vehicle 10. Consequently, the lateral displacement of one or more of the truck bolsters 29, 32, 35, 38 relative to the truck axles can be viewed as resulting in, representatively, shifting the solid dots 40, 43, 46, 49 to align with the positions marked by the open dots 29, 31, 34, 37, thus aligning with the centerline 61 of the rail vehicle 10. In reality, this must occur when the rail vehicle 10 traverses the curved track section because the center plates 28, 31, 34, 37 on the truck bolsters 29, 32, 35, 38 are attached at the mating center plate mounts 63, 64, 65, 66 on the car body 13, and thus will always be aligned with the centerline 61 of the rail vehicle 10. The movement of the truck bolsters 29, 32, 35, 38 and associated center plates 28, 31, 34, 37 to the laterally shifted positions, are shown as dashed outlines 29', 32', 35', 38' and 28', 31', 34', 37', respectively, in FIGS. 8 and 9.

If sufficient lateral displacement can be provided by only one of each pair of trucks 16, 19 and 22, 25 at each end of the rail vehicle 10, the other truck in the pairs would not need to displace as much, such that the normal amount of play inherent in conventional trucks may provide sufficient movement to make up for an additional, lesser amount of lateral displacement which may be required of the second truck in the pairs. However, in a certain preferred embodiment, each truck 16, 19, 22, 25 can have a movable bolster which provides a relatively high degree of lateral displacement capability, which permits the necessary lateral displacement to be more evenly shared between each truck 16, 19, 22, 25. Moreover, where each truck 16, 19, 22, 25 has a relatively high degree of lateral displacement capability, this can provide more freedom in the design of other parts of the rail vehicle 10, including, for example, the overall length of the rail vehicle, the spacing between center plate mounts on each end of the rail vehicle 10, the spacing between the truck pairs at each end of the rail vehicle 10, and other considerations.

The increased lateral displacement of the bolsters 29, 32, 35, 38 required from the trucks 16, 19, 22, 25 to permit the rail vehicle 10 to traverse curved track is beyond the normal by-product of the well known prior art type swing motion trucks, such as described previously in connection FIGS. 3 and 4. In fact, structural modification of the prior art type swing motion truck is required to provide the necessary degree of lateral displacement of the truck bolster. According to an embodiment of the invention, the increased range of lateral displacement of the truck bolster, such as the truck bolster 6 in FIGS. 3 and 4, relative to the truck axles can be obtained by providing greater spacing between the transom stops 9 at each side of the transom 8 of the swing motion truck. Alternatively, as can be understood, decreasing the distance between the bolster stops 7 at each side of the bolster 6 will have the same result. Either way, such modifications will provide a greater degree of lateral displacement for the truck bolster 6, since that displacement is defined by the distance between the transom stops 9 and the bolster stops 7, as measured when the bolster is in a centered, non-displaced position. The additional amount of roll provided by increasing the distance between the transom stops 9 and the bolster stops 7 increases the available lateral displacement of the truck bolster 6, and thus the center plate on the bolster 6, with respect the truck axles.

Additional adjustments can be made to further increase the available lateral displacement of the bolster 6. A prior art spring set 69 and a presently preferred embodiment of a spring set 70 are shown in FIGS. 11 and 12, respectively. As shown heretofore in FIGS. 3 and 4, the outboard ends of the truck bolster 6 are supported on a spring group 66. The spring group 66, which can be made up of multiple spring sets, can include spring sets such as spring sets 69 and 70. In accordance with an embodiment of the invention, the amount of lateral bolster 6 displacement which can be achieved in the truck can be further increased by specially modifying the spring sets. In particular, as shown in FIG. 12, the spring set 70 can include a taller spring 76 in addition to springs 73 and 79. Since each end of the bolster 6 rests on top of a spring group 66, a taller spring set within the spring group 66, such as tall spring set 70, can raise the height of the bolster 6. The increased height of the bolster 6 translates in an increased height of the bolster center plate. Since the bolster 6 is generally rigidly connected to truck at each end, the "center" of the center plate on the bolster can be thought of as a point which travels through an arc as the bolster 6 laterally displaces with respect to the truck axles. The height of the truck bolster is the radius of the arc. Thus, the increased height of the bolster 6 results in a correspondingly increased amount of lateral suspension travel, and thus lateral displacement of the bolster center plate. This occurs because, as the bolster 6 rolls, actually leans, relative to the axles, the increased height of the bolster 6 creates a larger radius and thus a larger arc though which the center plate of the bolster 6 traces as it leans. The larger the arc traced by the bolster 6, the greater the lateral displacement of the center plate. The height of the spring set 70 is in effect the radius of the arc about which the center point of the bolster travels. Thus, the taller the spring set 70, the greater the degree of lateral displacement created.

Consequently, it can be understood that providing an increased amount of spacing between the transom stops 9 and the bolster stops 7 of the swing motion truck, and/or by providing taller spring sets 70, the amount of lateral displacement which can be accommodated by the truck can be significantly increased. In fact, a pair of such specially modified trucks can be connected directly to the car body 13 at each of opposite ends of the rail vehicle 10, yet provide sufficient lateral displacement capability to enable the rail vehicle 10 to traverse curved track sections without the otherwise normally required span bolster connected intermediate each pair of trucks and the car body 13.

Increased suspension travel, enabled by increasing the distance between transom stops and the taller spring height, can also disadvantageously result in creating a greater overturning moment when the rail vehicle traverses curved track. However, the lower deck height enabled by eliminating the span bolster can offset this condition because center of gravity of the rail vehicle 10 can be lowered by a distance generally corresponding to the space between the car body 13 and the truck bolsters which was previously occupied by the span bolster. Moreover, the taller spring sets 70 can be designed to reduce roll problems by compensating for different load conditions of the rail vehicle. In particular, the taller coil 76 can have a softer spring rate and, therefore, would have its greatest extended height only if the rail vehicle 10 were essentially unloaded. If the rail vehicle 10 is heavily loaded, the taller, but softer spring 76 will compress, thus lowering the height, i.e., center of gravity, of the rail vehicle 10 thereby reducing the tendency for roll. On the other hand, if the rail vehicle 10 were unloaded, the taller spring 76 could lift the car body to a greater height, but the roll potential would be less because the lower weight would exert a correspondingly lower force acting to roll the rail vehicle 10 when it transverses a curved track section.

Although certain embodiments of the invention have been described in detail, it will be appreciated by those skilled in the art that various modification to those details could be developed in light of the overall teaching of the disclosure. Accordingly, the particular embodiments disclosed herein are intended to be illustrative only and not limiting to the scope of the invention which should be awarded the full breadth of the following claims and any and all embodiments thereof.

What is claimed is:

1. A rail vehicle comprising:

a. a car body;

b. at least two trucks supporting said car body at each of opposite ends thereof;

c. each of said at least two trucks having a bolster supported on a plurality of axles;

d. said bolster of each of said at least two trucks connected directly to said car body at each of said opposite ends thereof; and e. said bolster of at least one of said at least two trucks being laterally movable relative to said plurality of axles supporting said bolster.

2. The rail vehicle of claim 1 further comprising:

a. said bolster having a center plate;

b. at least two center plate mounts on each of said opposite ends of said car body; and c. said center plate of each of said at least two trucks connected to a respective one of said at least two center plate mounts on each of said opposite ends of said car body.

3. The rail vehicle of claim 1 further comprising:

a. each bolster of said at least two trucks being laterally movable relative to said plurality of axles supporting each said bolster; and b. each bolster movable in opposite lateral directions with respect to the other.

4. The rail vehicle of claim 3 further comprising:

a. at least one of said at least two trucks at each of said opposite ends of said car body having a transom member, said transom member having spaced apart transom stops;

b. said laterally movable bolster having at least one bolster stop bounded by and laterally movable between said transom stops such that lateral movement of said laterally movable bolster is defined by a distance between said transom stops; and c. said transom stops having an increased distance therebetween to increase said lateral movement.

5. The rail vehicle of claim 2 further comprising at least one of said at least two center plate mounts enabling lateral movement relative to said car body.

6. The rail vehicle of claim 1 further comprising at least one of said at least two trucks at each of said opposite ends of said car body having a spring set, said spring set having a plurality of springs, and at least one of said plurality of springs having a length greater than the others.

* * * * *

UNITED STATES PATENT AND TRADEMARK OFFICE

CERTIFICATE OF CORRECTION

PATENT NO. : 6,827,024 B2 
APPLICATION NO. : 10/387263
DATED : December 7, 2004
INVENTOR(S) : Gabe M. Kassab and Jon Odden It is certified that error appears in the above-identified patent and that said Letters Patent is hereby corrected as shown below:

The title page showing the illustrative figure should be replaced with the attached title page.

Drawing sheets 1 of 6, 2 of 6, 3 of 6, 5 of 6 and 6 of 6 should be replaced with formal drawing sheets 1 of 6, 2 of 6, 3 of 6, 5 of 6 and 6 of 6 attached hereto.

Signed and Sealed this

Twenty-sixth Day of August, 2008

JON W. DUDAS
*Director of the United States Patent and Trademark Office*

(12) United States Patent
Kassab et al.

(10) Patent No.: US 6,827,024 B2
(45) Date of Patent: Dec. 7, 2004

(54) MULTIPLE TRUCK RAIL VEHICLE WITH UNIFIED BOLSTER-CAR BODY

(75) Inventors: Gabe M. Kassab, Pittsburgh, PA (US); Jon Odden, Coon Rapids, MN (US)

(73) Assignee: Kasgro Rail Corp., New Castle, PA (US)

( * ) Notice: Subject to any disclaimer, the term of this patent is extended or adjusted under 35 U.S.C. 154(b) by 0 days.

(21) Appl. No.: 10/387,263

(22) Filed: Mar. 12, 2003

(65) Prior Publication Data

US 2003/0217669 A1 Nov. 27, 2003

Related U.S. Application Data

(60) Provisional application No. 60/367,041, filed on Mar. 22, 2002.

(51) Int. Cl.[7] ..... B61D 1/00

(52) U.S. Cl. ..... 105/157.1

(58) Field of Search ..... 105/151.1, 182.1, 105/185, 200, 201, 202

(56) References Cited

U.S. PATENT DOCUMENTS

| | | | | | |
|---|---|---|---|---|---|
| 1,144,329 | A | | 6/1915 | Howard et al. | |
| 1,504,252 | A | | 8/1924 | Larsen | |
| 1,762,887 | A | | 6/1930 | O'Brien | |
| 3,394,662 | A | | 7/1968 | Weber | |
| 5,315,934 | A | * | 5/1994 | List et al. | 105/199.3 |
| 5,327,837 | A | | 7/1994 | Weber | |
| 5,632,208 | A | | 5/1997 | Weber | |
| 5,802,981 | A | * | 9/1998 | Kassab | 105/176 |
| 5,802,982 | A | * | 9/1998 | Weber | 105/187 |

* cited by examiner

*Primary Examiner*—S. Joseph Morano
*Assistant Examiner*—Robert J. McCarry, Jr.
(74) *Attorney, Agent, or Firm*—Buchanan Ingersoll PC

(57) ABSTRACT

The invention provides a multiple axle rail vehicle wherein the car body of the rail vehicle is provided with multiple center plate members at each end of the car body. Multiple trucks are attached to each end of the car body with each truck individually connected to a respective center plate. Connecting each truck to an individual center plate on the car body eliminates the span bolster permitting the rail vehicle to weigh less and have a lower deck height.

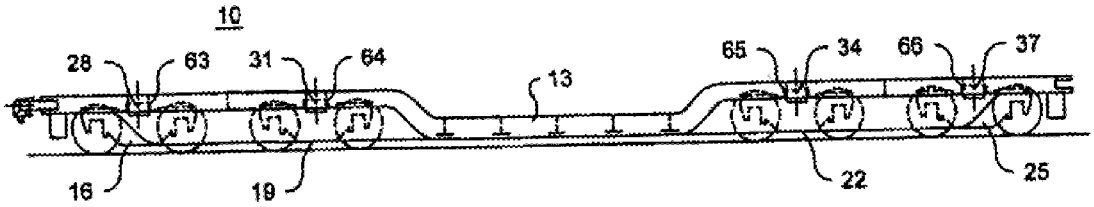

6 Claims, 6 Drawing Sheets